US006012802A

United States Patent [19]

Desie et al.

[11] Patent Number: 6,012,802

[45] **Date of Patent: *Jan. 11, 2000**

[54] DEVICE FOR DIRECT ELECTROSTATIC PRINT (DEP) COMPRISING INDIVIDUAL CONTROL PRINT AND CONTROL BACK ELECTRODES

[75] Inventors: Guido Desie, Herent; Jacques Leonard, Antwerp, both of Belgium

[73] Assignee: Agfa-Gevaert, Mortesel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/919,411

[22] Filed: Aug. 27, 1997

Related U.S. Application Data

[63] Continuation of application No. 08/544,914, Oct. 18, 1995, abandoned.

[30] Foreign Application Priority Data

Oct. 20, 1994 [EP] European Pat. Off. ..... 94203041

[51] Int. Cl.[7] ..... B41J 2/06

[52] U.S. Cl. ..... 347/55

[58] Field of Search ..... 347/131, 55, 112

[56] References Cited

U.S. PATENT DOCUMENTS

| | | | |
|---|---|---|---|
| 3,689,935 | 9/1972 | Pressman et al. | 347/55 |
| 4,478,510 | 10/1984 | Fujii et al. | 347/55 |
| 5,121,144 | 6/1992 | Larson et al. | 347/55 |
| 5,214,451 | 5/1993 | Schmidlin et al. | 347/55 |

FOREIGN PATENT DOCUMENTS

| | | | |
|---|---|---|---|
| 5-154173 | 12/1980 | Japan | B41J 3/04 |
| 62-290552 | 12/1987 | Japan | 347/55 |
| WO 9104863 | 4/1991 | WIPO . | |

OTHER PUBLICATIONS

Patent Abstracts of Japan, vol. 9, No. 62 (P–342) (1785) Mar. 19, 1985 and JP–A–59 195 671 (Matsushita) Nov. 6, 1984.

*Primary Examiner*—N. Le
*Assistant Examiner*—Michael Nghiem
*Attorney, Agent, or Firm*—Baker & Botts, L.L.P.

[57] ABSTRACT

A device for use in the technique of direct electrostatic printing (DEP) on an intermediate or final substrate is described, comprising a receiving member support 5 having control back electrodes 5*b* and a common shield back electrode 5*a*; a printhead structure 6 having control print electrodes 6*a* in combination with apertures 7 and a common shield print electrode 6*b*; a toner delivery means 1 presenting a cloud 4 of toner particles in the vicinity of said apertures 7. The control print electrodes 6*a* in the printhead structure 6 and the control back electrodes 5*b* in the receiving member support 5 are positioned in a 1 to 1 relationship, and the control electrodes of both the printhead structure 6 and the receiving member support 5 are driven in an imagewise manner by a variable voltage source, in order to get a specific toner density on the receiving member substrate 9.

12 Claims, 2 Drawing Sheets

DEVICE FOR DIRECT ELECTROSTATIC PRINT (DEP) COMPRISING INDIVIDUAL CONTROL PRINT AND CONTROL BACK ELECTRODES

This application is a continuation of application Ser. No. 08/544,914, filed on Oct. 18, 1995, now abandoned.

FIELD OF THE INVENTION

This invention relates to an apparatus used in the process of electrostatic printing and more particularly in Direct Electrostatic Printing (DEP). In DEP, electrostatic printing is performed directly from a toner delivery means on a receiving member substrate by means of an electronically addressable printhead structure and the toner has to fly in an imagewise manner towards the receiving member substrate.

BACKGROUND OF THE INVENTION

In DEP (Direct Electrostatic Printing) the toner or developing material is deposited directly in an imagewise way on a receiving member substrate, the latter not bearing any imagewise latent electrostatic image. The substrate can be an intermediate endless flexible belt (e.g. aluminium etc.). In that case the imagewise deposited toner must be transferred onto another final substrate. Preferentially the toner is deposited directly on the final receiving member substrate, thus offering a possibility to create directly the image on the final receiving member substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed by Pressman in U.S. Pat. No. 3,689,935. This document discloses an electrostatic line printer having a multi-layered particle modulator or printhead structure comprising

- a layer of insulating material, called isolation layer;
- a shield print electrode consisting of a continuous layer of conductive material on one side of the isolation layer;;
- a plurality of control print electrodes formed by a segmented layer of conductive material on the other side of the isolation layer; and
- at least one row of apertures.

Each control print electrode is formed around one aperture and is isolated from each other control print electrode.

Selected potentials are applied to each of the control print electrodes while a fixed potential is applied to the shield print electrode. An overall applied propulsion field between a toner delivery means and a receiving member support projects charged toner particles through a row of apertures of the printhead structure. The intensity of the particle stream is modulated according to the pattern of potentials applied to the control print electrodes. The modulated stream of charged particles impinges upon a receiving member substrate, interposed in the modulated particle stream. The receiving member substrate is transported in a direction orthogonal to the printhead structure, to provide a line-by-line scan printing. The shield print electrode may face the toner delivery means and the control print electrode may face the receiving member substrate. A DC field is applied between the printhead structure and a single shield back electrode on the receiving member support. This propulsion field is responsible for the attraction of toner to the receiving member substrate that is placed between the printhead structure and the shield back electrode.

This kind of printing engine, however, requires a rather high voltage source and expensive electronics for changing the overall density between maximum and minimum density, making the apparatus complex and expensive.

To overcome this problem several modifications have been proposed in the literature.

In U.S. Pat. No. 4,912,489 the conventional positional order of shield print electrode and the control print electrode—as described by Pressman—has been reversed. This results in lower voltages needed for tuning the printing density. In a preferred embodiment, this patent discloses a new printhead structure in which the toner particles from the toner delivery means first enter the printhead structure via larger apertures, surrounded by so-called screening electrodes, further pass via smaller apertures, surrounded by control print electrodes and leave the structure via a shield print electrode. The larger aperture diameter is advised in order to overcome problems concerning crosstalk.

In EP-A-0 587 366 an apparatus is described in which the distance between printhead structure and toner delivery means is made very small by using a scratching contact. As a result, the voltage—needed to overcome the applied propulsion field—is very small. The scratching contact, however, strongly demands a very abrasion resistant top layer on the printhead structure.

An apparatus working at very close distance between the printhead structure and the toner delivery means is also described in U.S. Pat. No. 5.281,982. Here a fixed but very small gap is created in a rigid configuration making it possible to use a rather low voltage to select wanted packets of toner particles. However, the rigid configuration requires special electrodes in the printhead structure and circuits to provide toner migration via travelling waves.

On the other hand it has been known for a long time that systems of the type "contrography" can be used to select toner particles according to an image pattern. In U.S. Pat. No. 4,568,955 e.g. a segmented receiving member support comprising different galvanically isolated styli as control back electrodes is used in combination with toner particles that are migrated with travelling electrostatic waves. The main drawback of this apparatus is its limited resolution and dependence of the image quality on environmental conditions and properties of the receiving member substrate.

In U.S. Pat. No. 4,733,256 some of these drawbacks are overcome by the introduction of a printhead structure, as described by Pressman. The printhead structure is located between the receiving member support

- which comprises different isolated wires as control back electrode
- and the toner delivery unit. For a line printer the density can be tuned by selecting an appropriate voltage for shield print electrode, control print electrode and control back electrode wire.

In U.S. Pat. No. 5,036,341 a device is described comprising a screen or lattice shaped control back electrode matrix as segmented receiving member support. This apparatus has the advantage that matrix-wide image information can be written to the receiving member substrate, but it also suffers from the environmental influences and those caused by the nature of the receiving member substrate.

To overcome these drawbacks Array Printers described in U.S. Pat. No. 5,121,144 another device wherein the segmented back electrode without printhead structure was changed into a two part electrode system, having a printhead electrode structure and a back electrode structure. A first part was placed between the toner delivery means and the receiving member substrate and consisted of parallel, isolated wires, being used as printhead structure. A second part consisted of another set of parallel wires, arranged orthogonally with respect to the first wires and was used as back electrode structure. The receiving member support or back electrode structure in all examples consists of isolated wires which are oriented in one direction. As printhead structure, there are described three different configurations:

1. isolated wires in a cross direction;
2. a flexible PCB with only control print electrodes in the cross direction; and
3. a flexible PCB with common shield print electrode and control print electrodes in the cross direction.

The different systems according to this patent make it possible to change the propulsion field in a group of apertures, tuning the density by setting the voltage of the different control print electrodes.

All the patents or applications mentioned above make the experimental configuration of the DEP-device much more complicated. On the other hand it would be very advantageous to have an apparatus with less complicated parts, being operative with very small voltages.

There is thus still a need to have a system for practising DEP, that—while avoiding the problems cited above—is based on a simpler structure, yielding high quality images in a reproducible and constant way.

OBJECT OF THE INVENTION

It is an object of the invention to provide an improved device for use in the method for Direct Electrostatic Printing (DEP) that makes it possible to print high quality images without complex and expensive electronic components.

Further objects and advantages of the invention will become clear from the description hereinafter.

The above objects are realized by providing a device for direct electrostatic printing on the front side of an intermediate or final receiving member substrate, comprising:

- a printhead structure, at the front side of the receiving member substrate, having a plurality of apertures each with one galvanically isolated control print electrode;
- a toner delivery means, at the front side of said printhead structure, providing toner particles in the vicinity of said apertures; and
- a support for the back side of the receiving member substrate, having a plurality of galvanically isolated control back electrodes;

characterized in that the of each control back electrode is aligned with just one such aperture.

Preferably the number of control back electrodes is equal to the number of control print electrodes.

We have found that both the control print electrodes and the control back electrodes can be driven at a voltage which is substantially lower than the voltage required to drive a system having no individual control back electrodes per pixel. A lower control voltage has important implications on the cost of the driving circuits. For example, circuits for driving a voltage of maximum 450 V are twice as expensive as circuits for driving up to 335 V. To drive circuits with a maximum voltage of 800 V, this cost increases by a factor ten to fifteen. It is thus more advantageous to install a printhead structure having control print electrodes and a receiving member support having control back electrodes with 2 times N low cost drivers than to install control print electrodes only with N high cost drivers. Moreover, by driving two electrodes for imaging a pixel, more control over the grey levels for that pixel is offered.

The individual control print electrodes and/or control back electrodes may preferably be supplied with a variable voltage, to vary the amount of toner deposited locally on the receiving member substrate. This will cause a varying density on the substrate. In a preferred embodiment, the printhead structure further comprises a shield print electrode, galvanically isolated from the control print electrodes and optionally a shield back electrode, galvanically isolated from the control back electrodes. Both shield electrodes cover nearly completely one side of the isolation layer on which they are applied.

In another preferred embodiment, toner particles are used in a DEP-device using a two-component development system.

DETAILED DESCRIPTION OF THE INVENTION

Figure 1:
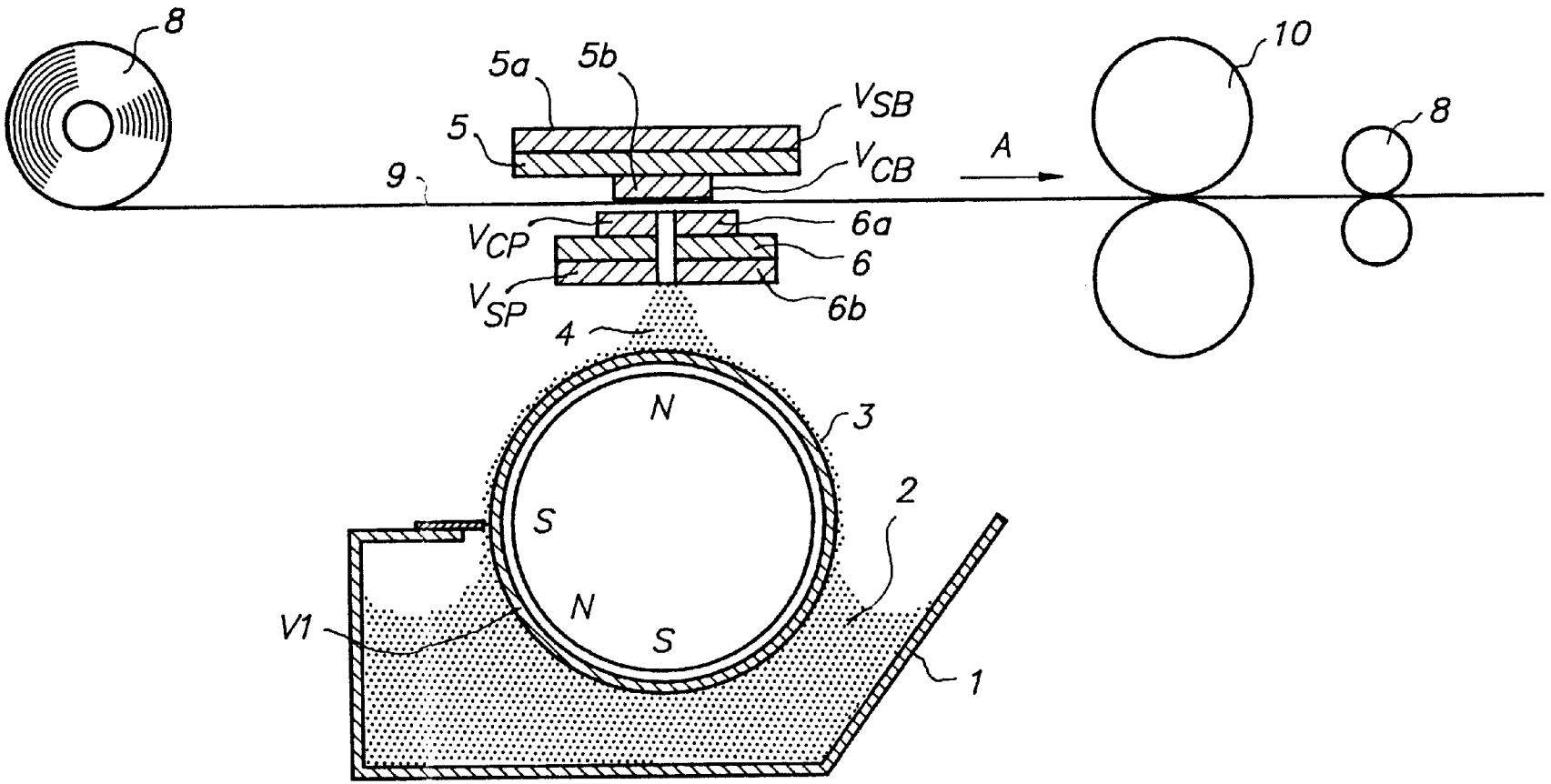
FIG. 1 a schematic illustration of a possible embodiment of a DEP device according to the present invention.

Many modifications of the principle of DEP (Direct Electrographic Printing) have hitherto been addressed to mechanical or electric changes in the printhead structure, and mechanical implications providing better and more accurate control over the requirements for the distances between toner delivery means, printhead structure and receiving member support.

We have found that when the receiving member support and the printhead structure are made to cooperate pixel per pixel—each pixel being produced by one aperture—a significant improvement in DEP quality of image density can be obtained.

DESCRIPTION OF THE DEP DEVICE

A device for implementing DEP according to one embodiment of the present invention comprises (FIG. 1):

(i) a toner delivery means 1, comprising a container for developer 2 and a magnetic brush assembly 3, this magnetic brush assembly forming a toner cloud 4.

(ii) a receiving member support 5, made from plastic insulating film, coated with a metallic film on one single or both sides. The receiving member support 5 comprises a complex addressable electrode structure, hereinafter called "control back electrode" 5*b*. This control back electrode structure is preferentially located at the receiver side or front side of the receiving member support 5. A continuous electrode surface—called shield back electrode 5*a*—may be located on the other side of the receiving member support 5.

(iii) a printhead structure 6, made from a plastic insulating film, coated with a metallic film on both sides. The printhead structure 6 comprises one continuous electrode surface, hereinafter called "shield print electrode" 6*b* facing in the shown embodiment the toner delivery means. The printhead structure further comprises a complex addressable electrode structure, hereinafter called "control print electrode" 6*a,* around aperature or apertures 7, (as shown in FIG. 2) facing—in the shown embodiment—the receiving member substrate in said DEP device. The location of the shield print electrode 6*b* and the control print electrode 6*a* can, in other embodiments for a DEP device according to the present invention, be different from the location shown in FIGS. 1 and 2. The printhead structure is located in the device of the present invention in such a way that toner—propelled through each individual aperture 7—impinges upon the center of the control back electrode 5*b*. Therefore, as shown in FIG. 2, the control back electrodes 5*b* are arranged in a 1:1 relationship with said aperture 7 in the printhead structure 6.

(iv) conveyor means 8 to convey a member receptive for said toner image—called receiving member substrate 9—between said printhead structure 6 and said receiving member support 5 in the direction indicated by arrow A.

(v) means for fixing 10 said toner onto said image receiving member substrate 9.

Figure 2:
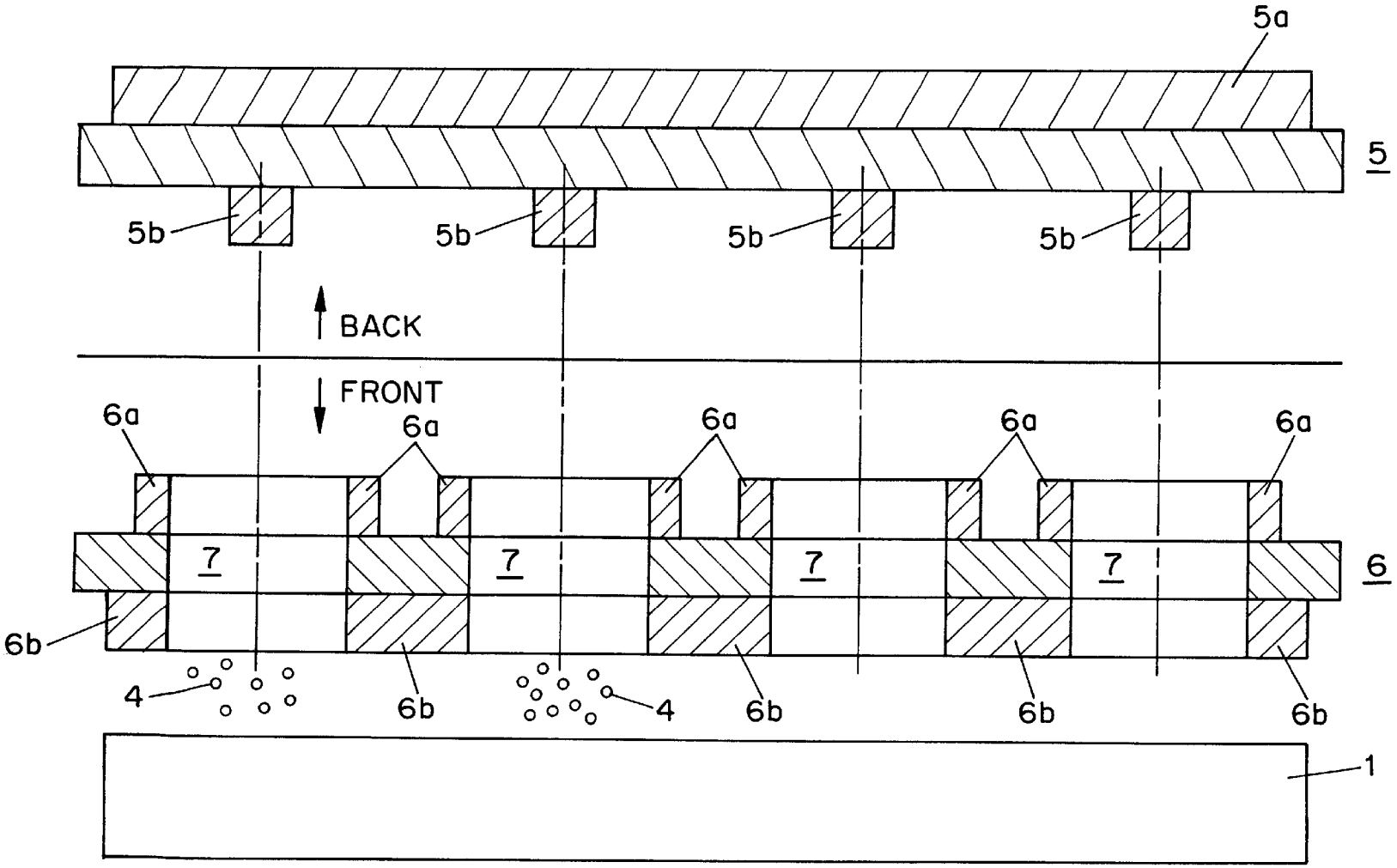
FIG. 2 is a cross-sectional view of another possible embodiment of a DEP device according to the present invention.

Although in FIGS. 1 and 2 a preferred embodiment of a DEP device—using two electrodes (6*a* and 6*b*) on printhead structure 6—is shown, it is possible to realise a DEP device according to the present invention using different constructions of the printhead structure 6. It is e.g. possible to provide a device having a printhead structure comprising only one control print electrode structure 6*a* as well as more than two electrode structures (6*a*, 6*b* and more). The apertures in these printhead structures can have a constant diameter, or can have a larger entry or exit diameter. The DEP device according to the present invention can also be provided with an electrode mesh array as printhead structure.

The receiving member support of this DEP device can also be made of plastic film having at one side only a conductive film coating, comprising different addressable control back electrodes and at the same side an overall shield back electrode, said shield back electrode being isolated from said control back electrodes.

In the embodiment shown in FIG. 1. different electrical fields may be applied :

a) between the magnetic brush assembly 3 and the shield print electrode 6*b;* b) between the shield print electrode 6*b* and the control print electrode 6*a* around the aperture 7;

c) between the control print electrode 6*a* of the printhead structure 6 and the control back electrode 5*b*; and d) between the control back electrode 5*b* and the shield back electrode 5*a*.

In a specific embodiment of a DEP device, according to the present invention, shown in FIG. 1. voltage $V_1$ is applied to the sleeve of the magnetic brush assembly 3, a voltage $V_{SP}$ to the shield print electrode 6*b*, FIG. 2 shows means 18 for supplying a voltage on each individual control print electrode 6*a* and variable voltage $V_{CP}$ ranging from $V_{CP0}$ up to $V_{CPn}$ for the individual control print electrodes 6*a*. Herein, $V_{CP0}$ is the lowest voltage level applied to the control print electrode, and $V_{CPn}$ the highest voltage applied to said electrode. Usually a selected set of discrete voltage levels $V_{CP0}, V_{CP1}, \ldots$ can be applied to the control print electrode. The value of the variable voltage $V_{CP}$ is selected between the values $V_{CP0}$ and $V_{CPn}$ from the set, according to the digital value of the image forming signals, representing the desired grey levels. Alternatively, the voltage can be modulated on a time basis according to the grey-level value. Voltage $V_{SB}$ is applied to the shield back electrode 5*a* on the receiving member support 5 behind the toner receiving member. A variable voltage $V_{CB}$, is applied to the control back electrodes 5*b*. FIG. 2 shows means 16 for supplying a voltage on each individual control back electrode 6*b* having a value between $V_{CB0}$ and $V_{CBn}$.

In a DEP device according to a preferred embodiment of the present invention, said toner delivery means 1 creates a layer of multi-component developer on a magnetic brush assembly 3, and the toner cloud 4 is directly extracted from said magnetic brush assembly 3. In other systems known in the art, the toner is first applied to a conveyor belt and transported on this belt in the vicinity of the apertures. A device according to the present invention is also operative with a mono-component developer or toner, which is transported in the vicinity of the apertures 7 via a conveyor for charged toner. Such a conveyor can be a moving belt or a fixed belt. The latter comprises an electrode structure generating a corresponding electrostatic travelling wave pattern for moving the toner particles.

The magnetic brush assembly 3 preferentially used in a DEP device according to an embodiment of the present invention can be either of the type with stationary core and rotating sleeve or of the type with rotating core and rotating or stationary sleeve.

Description of carrier particles for use in a preferred embodiment of the present invention For the stationary core/rotating sleeve type magnetic brush the carrier particles are preferably "soft" magnetic particles, characterized with a coercivity value ranging from about 50 up to 250 Oe, said carrier particles being rather homogeneous ferrite particles or composite magnetic particles. Ferrites are generally represented by the formula $MeO.Fe_2O_3$, wherein Me denotes at least one divalent metal such as Mn, Ni, Co, Mg, Ca, Zn and Cd, further on doped with monovalent or trivalent ions.

As soft magnetic carrier particles it is preferred to use composite carrier particles, comprising a resin binder and a mixture of two magnetites having a different particle size as described in EP-B-0 289 663. The particle size of both magnetites will vary between 0.05 and 3 $\mu$m.

For the rotating core/rotating or stationary sleeve type magnetic brush the carrier particles are preferably "hard" magnetic particles.

Here again homo-particles as well as composite particles can be used. The homo-particles are preferably hard ferrite macro-particles. By hard magnetic macro-particles are understood particles with a coercivity of at least 250 Oe, most preferably 1000 Oe, when magnetically saturated, the magnetisation being at least preferably 20 emu/g of carrier material. Useful hard magnetic materials include hard ferrites and gamma ferric oxide. The hard ferrites are represented by a similar composition as cited above, whereby specific ions such as Ba, Pb, or Sr are used as disclosed in U.S. Pat. No. 3,716,630.

However, it is preferred to use composite particles as they give a lower specific gravity and are more flexible in design. In this case the hard magnetic particles are present in a fine form, called pigment, but are essentially of the same chemical composition.

The hard magnetic pigments then show a coercivity of at least 250 Oe, preferably at least 1000 Oe, and more preferably at least 3000 Oe. In this regard, while magnetic materials with coercivity levels of 3000 and 6000 Oersted have been found useful, there appears to be no theoretical reason why higher coercivity levels would not be useful.

Useful hard magnetic pigments include hard ferrites and gamma ferric oxide. The hard ferrites are represented by a similar composition as cited above, whereby specific ions such as $Ba^{2+}$, $Pb^{2+}$, or $Sr^{2+}$ are used as disclosed in U.S. Pat. No. 3,716,630.

Also a composite carrier comprising a binder resin and a mixture of both "soft" and "hard" magnetic particles can be used as the "hard" magnetic carrier to be used in a DEP device according to a preferred embodiment of the present invention. When using such a composite carrier it is preferred that said carrier particles comprise a mixture of magnetic pigment particles wherein a portion (A) of said pigment particles has a coercive force of more than 250 Oe and another portion (B) of said magnetic pigment particles has a coercive force of less than 250 Oe, the weight ratio of said portions (A) and (B) being in the range of 0.1 to 10.

Although the exact value of the induced magnetic moment of the carrier particles has to be adapted to the specifics of the magnetic brush assembly, said carrier particles preferably have, independently of the type of magnetic brush used in a DEP device according to a preferred embodiment of the present invention, an induced magnetic moment B between 10 and 100 emu/gm, more specifically between 20 and 75 emu/g based on the weight of the carrier, when present in a field of 1000 Oersted, after full magnetisation.

The typical particle size of the carrier particles to be used in accordance with a preferred embodiment of the present invention, can be chosen over a broad range. It is however useful to define the particle size small enough in order to increase the specific surface area of the carrier and hence its capability to offer a larger interacting surface to the toner particles. On the other hand some care should be taken not to go for too fine particles, as they might become too weakly bond to the magnetic field of the magnetic brush assembly. In such a case they may become airborne from the moving brush by centrifugal forces or may be stripped too easily in electrical fields or be lost from the brush by mechanical impact of the magnetic hairs with interacting components of the marking engine e.g. the printhead structure. It has been found most favourable to use a particle size in the range of 20 to 200 $\mu$m, more specifically in the range of 40 to 150 $\mu$m. The diameter refers to the typical volume average particle diameter of the carrier beads, as it may be determined by sieving techniques. The carrier beads can be used as such, i.e. uncoated, or they may be coated with inorganic as well as organic or mixed coatings. Typical coating thickness is in the range of 0.5 to 2.5 $\mu$m. The coating may be used to induce different properties such as for example tribo-electrical charging, friction reduction, wear resistance, etc.

Description of toner particles for use in the present invention

The toner particles used in a DEP device according to the present invention can essentially be of any nature as well with respect to their composition, size, shape, preparation method and the sign of their tribo-electrically acquired charge.

In a DEP process according to the present invention it is possible to use black toners and coloured toners. The toner composition can comprise charge controlling additives, flow regulating agents etc. Examples of useful toner compositions can be found in, e.g., EP-A-0 058 013, U.S. Pat. No. 4,652,509, U.S. Pat. No. 4,647,522, U.S. Pat. No. 5,102,763.

The toner for use in combination with carrier particles in a DEP process according to a preferred embodiment of the present invention can be selected from a wide variety of materials, including both natural and synthetic resins and charge controlling agents as disclosed e.g. in U.S. Pat. No. 4,076,857 and U.S. Pat. No. 4,546,060.

The shape of the conventional toner particles is normally irregular. However, spheroidal toner particles can be obtained by different fabrication processes. Spheroidization may e.g. proceed by spray-drying or the heat-dispersion process disclosed in U.S. Pat. No. 4,345,015.

Further, the toner particles according to the present invention have preferably an average volume diameter ($d_{v,50}$) between 3 and 20 $\mu$m, more preferably between 5 and 10 $\mu$m when measured with a COULTER COUNTER (registered trade mark) Model TA II particle size analyzer, operating according to the principles of electrolyte displacement in narrow aperture, and marketed by COULTER ELECTRONICS Corp. Northwell Drive, Luton, Bedfordshire, LC 33, UK.

Preferably the toner particles, to be used in a preferred embodiment of the present invention, will acquire, upon tribo-electric contact with the carrier particles, a charge (q)—expressed in fC (femtoCoulomb)—that can be either negative or positive, such that $1\ fC \leqq |q| \leqq 20\ fC$, more preferably such that $1\ fC \leqq |q| \leqq 10\ fC$.

It is possible to have fairly low charged toner particles and avoid wrong sign toner by having toner particles with very homogeneous charge distribution.

Preferably the toner particles useful according to the present invention contain :

(1) at least one tribo-electrically chargeable thermoplastic resin serving as binder having a volume resistivity of at least $10^{13}$ Ω.cm, and (2) at least one resistivity lowering substance having a volume resistivity lower than the volume resistivity of said binder, wherein said substance(s) (2) is (are) capable of lowering the volume resistivity of said binder by a factor of at least 3.3 when present in said binder in a concentration of 5% by weight relative to the weight of said binder, and wherein said toner powder containing toner particles including a mixture of said ingredients (1) and (2) under tribo-electric charging conditions is capable of obtaining an absolute median (q) charge value (x) lower than 20 fC but not lower than 1 fC, and said toner powder under the same tribo-electric charging conditions but free from said substance(s) (2) then has an absolute median q value (x) at least 50% higher than when said substance(s) (2) is (are) present, and wherein the distribution of the charge values of the individual toner particles is characterized by a coefficient of variation $v \leqq 0.5$. preferably $\leqq 0.33$.

Said coefficient of variation (v) is the standard deviation (s) divided by the median value (x).

The spread of charge values of individual toner particles containing said ingredients (1) and (2) is called standard deviation (s) which for obtaining statistically realistic results is determined at a particle population number of at least 10,000. Said standard deviation divided by said median yields according to the present invention an absolute number equal to or smaller than 0.5. The median q value must be expressed in fC and stem from a curve of occurrence frequency distribution of a same charge (in y-ordinate) versus number of observed toner particles (in x-abscissa). The median is that value of the x-coordinate at which the area under the curve is bisected in equal area parts.

The tribo-electric properties of toner particles as described above are measured by means of a charge spectrograph apparatus (q-meter, Dr. R. Epping PES-Laboratorium D-8056 Neufahrn, Germany) as described in the EP-A 94201026.5. The measurement result is expressed as percentage particle frequency (in ordinate) of same q/d ratio on q/d ratio expressed as fC/10 $\mu$m (in abscissa).

Toner compositions showing a narrow charge distribution are disclosed in EP-A 93201644.7. EP-A 93201352.7 and EP-A 93201351.9. These applications are incorporated by reference.

Description of the developer composition useful in a preferred embodiment of the invention Toner particles and carrier particles, as described above are finally combined to give a high quality electrostatic developer. This combination is made by mixing said toner and carrier particles in a ratio (w/w) of 1.5/100 to 25/100, preferably in a ratio (w/w) of 3/100 to 10/100.

To enhance the flowability of the developer composition, according to the present invention, it is possible to mix toner particles, with flow improving additives. These flow improving additives are preferably extremely finely divided inorganic or organic materials, the primary (i.e. non-clustered) particle size of which is less than 50 nm. Widely used in this context are fumed inorganics of the metal oxide class, e.g. selected from the group consisting of silica ($SiO_2$), alumina ($Al_2O_3$), zirconium oxide and titanium dioxide or mixed oxides thereof which have a hydrophillic or hydrophobized surface.

The fumed metal oxide particles have a smooth, substantially spherical surface and are preferably coated with a hydrophobic layer, e.g. formed by alkylation or by treatment with organic fluorine compounds. Their specific surface area is preferably in the range of 40 to 400 $m^2/g$.

In preferred embodiments the proportions for fumed metal oxides such as silica ($SiO_2$) and alumina ($Al_2O_3$) are admixed externally with the finished toner particles in the range of 0.1 to 10% by weight with respect to the weight of the toner particles.

Fumed silica particles are commercially available under the tradenames AEROSIL and CAB-O-Sil being trade names of Degussa, Frankfurt/M Germany and Cabot Corp. Oxides Division, Boston, Mass., U.S.A. respectively. For example, AEROSIL R972 (tradename) is used. This is a fumed hydrophobic silica having a specific surface area of 110 $m^2/g$. The specific surface area can be measured by a method described by Nelsen and Eggertsen in "Determination of Surface Area Adsorption measurements by continuous Flow Method", Analytical Chemistry, Vol. 30, No. 9 (1958) p. 1387–1390.

In addition to the fumed metal oxide, a metal soap e.g. zinc stearate, as described in the United Kingdom Patent Specification No. 1,379,252, wherein also reference is made to the use of fluor containing polymer particles of submicron size as flow improving agents, may be present in the developer composition to be used in a DEP device according to the present invention.

A DEP device making use of marking toner particles according to the present invention can be addressed in a way that enables it to give not only black and white, i.e. being operated in a "binary way" but also to give an image with a plurality of grey levels. Grey level printing can be controlled by either an amplitude modulation of the voltage $V_{CP}$ and/or $V_{CB}$ applied on the control print electrode 6*a* and/or control back electrode 5*b* or by a time modulation of these voltages. By changing the duty cycle of the time modulation at a specific frequency, it is possible to print accurately fine differences in grey levels. It is also possible to control the grey level printing by a combination of an amplitude modulation and a time modulation of the voltage $V_{CP}$ and/or $V_{CB}$.

The combination of a high spatial resolution and of the multiple grey level capabilities opens the way for multilevel halftoning techniques, such as e.g. described in the EP-A 94201875.5. This enables the DEP device, according to the present invention, to render high quality images, without going into the design and construction of a complex, costly and unreliable apparatus.

It can be advantageous to combine a DEP device, according to the present invention, in one apparatus together with a classical electrographic or electrophotographic device, in which a latent electrostatic image on a charge retentive surface is developed by a suitable material to make the latent image visible. In such an apparatus, the DEP device according to the present invention and the classical electrographic device are two different printing devices. Both may print images with various grey levels and alphanumeric symbols and/or lines on one sheet or substrate. In such an apparatus the DEP device according to the present invention can be used to print fine tuned grey levels (e.g. pictures, photographs, medical images etc. that contain fine grey levels) and the classical electrographic device can be used to print alphanumeric symbols, line work etc. Such graphics do not need the fine tuning of grey levels. In such an apparatus—combining a DEP device, according to the invention with a classical electrographic device—the strengths of both printing methods are combined.

EXAMPLE 1

A printhead structure 6 was made from a polyimide film of 100 $\mu$m thickness, double sided coated with a 15 $\mu$m thick copperfilm. The printhead structure 6 had one continuous electrode surface 6*b* facing the toner delivery means. On the other side of the polyimide film—facing the receiving-member substrate—a complex addressable control print electrode structure 6*a* was created. The addressable control print electrode structure 6*a* was made by conventional techniques used in the micro-electronics industry, using fotoresist material, film exposure, and subsequent etching techniques. No surface coatings were used in this particular example. The apertures 7 were 150 $\mu$m in diameter, being surrounded by a circular control print electrode structure 6*a* in the form of a ring with a diameter of 300 to 600 $\mu$m. The apertures were arranged in different regions in such a way as to obtain a linear pitch of 400 $\mu$m in one region and 900 $\mu$m in another region.

A receiving member support 5 was made in the same way as the printhead structure except for the fact that no apertures were made in the polyimide film. The receiving member support 5 was arranged in the apparatus in such a way that each individual control print electrode ring 6*a* in the printhead structure 6 was placed in the same z-position as the corresponding control back electrode ring 5*b* in the receiving member support 5. Both control electrodes 6*a* and 5*b* in printhead structure 6 and in receiving member support 5 were connected to different power supplies which were variable for each individual control electrode 6*a* and 5*b*. The common shield print electrode 6*b* of the printhead structure 6 was connected to ground, while the common shield back electrode 5*a* of the receiving member support 5 was connected to a voltage source at +400 V.

The toner delivery means 1 was a stationary core/rotating sleeve type magnetic brush comprising two mixing rods and one metering roller. One rod was used to transport the developer through the unit, the other one to mix toner with developer.

The magnetic brush assembly 3 was constituted of the so called magnetic roller, which in this case contained inside the roller assembly a stationary magnetic core, showing nine magnetic poles of 500 Gauss magnetic field intensity and with an open position to enable used developer to fall off from the magnetic roller. The magnetic roller contained also a sleeve, fitting around said stationary magnetic core, and giving to the magnetic brush assembly an overall diameter of 20 mm. The sleeve was made of stainless steel roughened with a fine grain to assist in transport (<50 μm). A scraper blade was used to force developer to leave the magnetic roller. And on the other side a doctoring blade was used to meter a small amount of developer onto the surface of said magnetic brush assembly. The sleeve was rotating at 100 rpm, the internal elements rotating at such a speed as to conform to a good internal transport within the development unit.

Carrier particles

A macroscopic "soft" ferrite carrier consisting of a MgZn-ferrite with average particle size 50 μm, a magnetisation at saturation of 29 emu/g was provided with a 1 μm thick acrylic coating. The material showed virtually no remanence.

Toner particles

In the printing experiments following toner composition was used: 97 parts of a co-polyester resin of fumaric acid and propoxylated bisphenol A, having an acid value of 18 and volume resistivity of $5.1\times10^{16}$ ohm.cm was melt-blended for 30 minutes at 110° C. in a laboratory kneader with 3 parts of Cu-phthalocyanine pigment (Colour Index PB 15:3). A resistivity decreasing substance—having the following structural formula: $(CH_3)_3NC_{16}H_{33}Br$—was added in a quantity of 0.5% with respect to the binder. It was found that—by mixing with 5% of said ammonium salt—the volume resistivity of the applied binder resin was lowered to $5\times10^{14}$ Ω.cm. This proves a high resistivity decreasing capacity (reduction factor:100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner, measured by Coulter Counter model Multisizer (tradename), was found to be 6.3 μm average by number and 8.2 μm average by volume. The average particle size by volume is represented hereinafter by $d_{v,50}$. In order to improve the flowability of the toner mass, the toner particles were mixed with 0.5% of hydrophobic colloidal silica particles (BET-value 130 $m^2/g$).

An electrostatographic developer was prepared by mixing said mixture of toner particles and colloidal silica in a 4% ratio (w/w) with carrier particles as defined above. The tribo-electric charging of the toner-carrier mixture was performed by mixing said mixture in a standard tumbling set-up for 10 min. The developer mixture was run in the development unit (magnetic brush assembly) for 5 minutes, after which the toner was sampled and the tribo-electric properties were measured.

The distance 1 between the front side of the printhead structure 6 and the sleeve of the magnetic brush assembly 3, was set at 450 μm. The distance between the receiving member support 5 and the back side of the printhead structure 6 (i.e. control print electrodes 6*a*) was set to 150 μm and the paper travelled at 1 cm/sec. The shield back electrode 5*a* of the receiving member support 5 was connected to a power supply at $V_{SB}$=+400 V. The control back electrodes 5*b* of the receiving member support 5 were set, in an imagewise manner, to the voltages $V_{CB}$ mentioned in the second column of table 1 below. The magnetic brush assembly 3 was connected to an AC power supply with a square wave oscillating field of 600 V at a frequency of 3.0 kHz with 0 V DC-offset. The shield print electrode 6*b* was grounded: $V_{SP}$=0 V. To the individual control print electrodes an (imagewise) voltage $V_{CP}$ between 0 V and −400 V was applied as shown in the third column of table 1. The fourth column in table 1 gives an indication of the density that was obtained. The figures were obtained by photographic enlargement of printed pixels and counting the toner particles within one pixel by visual inspection.

TABLE 1

| Test | $V_{CB}$ | $V_{CP}$ | Density |
|---|---|---|---|
| 1 | 0 V | 0 V | 100% |
| 2 | 0 V | −400 V | 18% |
| 3 | −400 V | 0 V | 10% |
| 4 | −400 V | −400 V | 21% |
| 5 | −200 V | −200 V | 19% |
| 6 | −300 V | −300 V | 17% |

From test 1 it follows that—when the shield back electrode 5*a* is kept at +400 V and the shield print electrode 6*b* is kept at 0 V and further the control back electrode 5*b* and control print electrode 6*a* are grounded—the toner particles preferentially travel through the aperture 7 and maximally cover the receiving member substrate 9 with toner. The density obtained by this test 1 is indicated by a value normalized to 100%. The number of toner particles counted within such a pixel is taken as a reference for the subsequent tests.

In test 2, we tried to approximate the case—as in the prior art U.S. Pat. No. 3,689,935—where no control back electrode is present (although it is present with $V_{CB}$=0 V) and the toner particles are maximally prevented from travelling through the aperture 7 by a repelling voltage $V_{CP}$ of −400 V at the control print electrode. We see in the last column of test 2 that only a density of 18% was obtained.

In test 3, we tried to approximate the case where no control print electrode were present by setting $V_{CP}$=0 V. This is comparable to the prior art described in U.S. Pat. No. 5,036,341 (Array Printers), but is different by the fact that in the current invention a printhead structure having apertures is provided along with the individual control back electrodes, which is not the case in the prior art document. The toner particles in test 3 are maximally repelled back to the toner source by a voltage $V_{CB}$ of −400 V at the control back electrode. The last column of test 3 shows that the density is decreased to 10%. However, since the only repulsion field is applied through the receiving member substrate, the resulting density is largely dependent on the nature of the receiving member substrate and environmental conditions.

Test 4: the combination of a high blocking voltage on both the control back electrode and the control print electrode gives no spectacular improvement on the repulsion of toner particles. At first glance, this could be an indication that the combined usage of control back and control print electrodes has no advantage with respect to the printing process.

Test 5: The same combination as in test 4, however at lower voltages (−200 V), gives unexpectedly the same quality as in test 2 at −400 V. Usage of lower voltages has the advantage that the electronics are less complex, and yet the same performance as in tests 2 and 4 are obtained.

Test 6 shows that a higher voltage of −300 V at both electrodes gives no substantial improvement in the printed result. From this last test it is evident that the voltages used in test 5 are sufficient to obtain the required quality.

EXAMPLE 2

Direct electrostatic prints were made in the same way as described in example 1. However, the receiving member support 5 was constructed in a different way. The control back electrodes 5*b* were located on the polyimide layer 5 on the side facing the receiving member substrate 9, as in example 1. The shield back electrode 5*a* was—unlike example 1—constructed on the same side as and enclosing the control back electrodes 5*b*. The side of the receiving member support 5, not facing the receiving member substrate, was not covered by a conductive layer, which is also different from example 1. The same tests as in the previous example were done, i.e. $V_{SB}$=+400 V, $V_{SP}$=0 V, $V_{CB}$=Variable (second column of Table 2) and $V_{CP}$=Variable (third column of Table 2). The resulting densities—normalized as in Table 1 above—are summarized in the last column of Table 2.

TABLE 2

| Test | $V_{CB}$ | $V_{GP}$ | Density |
|---|---|---|---|
| 1 | 0 V | 0 V | 100% |
| 2 | 0 V | −400 V | 12% |
| 3 | −400 V | 0 V | 8% |
| 4 | −400 V | −400 V | 15% |
| 5 | −200 V | −200 V | 14% |
| 6 | −300 V | −300 V | 10% |

From test 5 and 6 it is again apparent that lower voltages (respectively −200 V and −300 V) on both control back electrode 5*b* and control print electrode 6*a* give a density score that compares well with the results obtained by higher voltages (−400 V) in tests 2 and 3.

Having described in detail preferred embodiments of the current invention, it will now be apparent to those skilled in the art that numerous modifications can be made therein without departing from the scope of the invention as defined in the following claims.

We claim:

1. A method for direct electrostatic printing in a system having:

a receiving member substrate having a front side and a back side opposite said front side; and an electrostatic printing device for producing a toner image having a variable density on said front side of said receiving member substrate, said printing device having:

a printhead structure facing said front side of said receiving member substrate, said printhead structure having a back side facing said front side of said receiving member substrate and a front side opposite said back side, said printhead structure having a plurality of apertures and corresponding galvanically isolated control print electrodes disposed therearound on the back side of the printhead structure, each of said control print electrodes being coupled to a power supply providing a variable voltage $V_{CP}$ having a value between a first voltage level $V_{CP0}$ and a second voltage level $V_{CPn}$;

toner delivery means disposed at said front side of said printhead structure for providing charged toner particles;

means for generating an electrical field for propelling the toner particles through said printhead structure and towards said receiving member substrate; and a receiving member support facing said back side of said receiving member substrate, said support having a front side facing said back side of said receiving member substrate and a back side opposite said front side of said support, said support having a plurality of galvanically isolated control back electrodes, each of said control back electrodes having a center which is aligned with one of said apertures, each of said control back electrodes being arranged in a one to one relationship with a corresponding one of said control print electrodes and being coupled to a power supply providing a variable voltage $V_{CB}$ having a value between a third voltage level $V_{CBO}$ and a fourth voltage level $V_{CBn}$, wherein said voltage levels $V_{CPO}$ and $V_{CBO}$ are for printing a maximum density $D_{max}$ and said voltage levels $V_{CPn}$ and $V_{CBn}$ are for printing a minimum density $D_{min}$;

said method comprising the steps of:

providing said toner particles proximate said apertures of said printhead structure by said toner delivery means;

propelling a portion of the toner particles through said apertures and towards said receiving member substrate so as to print the toner image at said minimum density $D_{min}$, said propelling step comprising the steps of:

supplying at least one of said control back electrodes with said variable voltage $V_{CB}=V_{CBn}/2$; and supplying a corresponding at least one of said control print electrodes with said variable voltage $V_{CP}=V_{CPn}/2$.

2. The method of claim 1, wherein said propelling step further comprises supplying a voltage $V_{SP}$ to a shield print electrode disposed on the printhead structure and galvanically isolated from the control print electrodes.

3. The method of claim 2, wherein said propelling step further comprises supplying a voltage $V_{SP}$ to a shield print electrode covering a substantial portion of the front side of the printhead structure and galvanically isolated from the control print electrodes.

4. The method of claim 1, wherein said propelling step further comprises supplying a voltage $V_{SB}$ to a shield back electrode disposed on the receiving member support and galvanically isolated from the control back electrodes.

5. The method of claim 4, wherein said toner providing step comprises providing the toner particles directly from a magnetic brush assembly.

6. The method of claim 5, wherein said step of propelling said toner particles comprises supplying a voltage V1 to the magnetic brush assembly.

7. The method of claim 1, wherein said toner providing step comprises providing the toner particles directly from a magnetic brush assembly.

8. The method of claim 7, wherein said step of propelling said toner particles comprises supplying a voltage V1 to the magnetic brush assembly.

9. In a method of forming a toner image in a direct electrostatic printing system having toner delivery means for providing charged toner particles, a receiving member for receiving the toner particles, a printhead structure on one side of the receiving member having a plurality of apertures, corresponding individually addressable control print electrodes and a shield print electrode, and a receiving member support having a plurality of individually addressable control back electrodes corresponding to the control print electrodes and a shield back electrode, the improvement comprising:

supplying at least one of the control back electrodes with a voltage $V_{CB}=V_{CBn}/2$, wherein $V_{CB}$ ranges between a voltage level $V_{CBO}$ corresponding to a maximum density $D_{max}$ and a voltage level $V_{CBn}$ corresponding to a minimum density $D_{min}$; and supplying a corresponding at least one of the control print electrodes with a voltage $V_{CP}=V_{CPn}/2$, wherein $V_{CP}$ ranges between a voltage level $V_{CPO}$ corresponding to the maximum density $D_{max}$ and a voltage level $V_{CPn}$ corresponding to the minimum density $D_{min}$; and further wherein said steps of supplying the voltages $V_{CB}=V_{CBn}/2$ and $V_{CP}=V_{CPn}/2$ result in the toner image being printed at the minimum density $D_{min}$.

10. The method of claim 9, further comprising supplying a voltage $V_{SP}$ to the shield print electrode.

11. The method of claim 9, further comprising supplying a voltage $V_{SB}$ to the shield back electrode.

12. The method of claim 9, further comprising supplying a voltage V1 to the toner delivery means.

* * * * *

UNITED STATES PATENT AND TRADEMARK OFFICE

CERTIFICATE OF CORRECTION

PATENT NO. : 6,012,802
DATED : January 11, 200
INVENTOR(S) : Desie, et. al.

It is certified that error appears in the above-identified patent and that said Letters Patent is hereby corrected as shown below:

Column 2, line 62: "¶which" should read -- —which -- (append to previous line); and "back" should read -- back electrode— --;

Column 2, line 63: "electrode" should be deleted;

Column 2, line 64: "¶and" should read -- and -- (append to previous line);

Column 5, line 59: "FIG. 2 shows...etc." through line 61: "trode 6*a*" should be deleted;

Column 5, line 61: "6*a*. Herein," should read -- 6*a*. FIG. 2 shows means 18 for supplying a voltage on each individual control print electrode 6*a*. Herein, --;

Column 6, line 6: "$V_{CB}$, is" should read -- $V_{CB}$, having a value between $V_{CB0}$ and $V_{CBn}$, is --;

Column 6, line 8: "6*b* having" should read -- 6*b*. --;

Column 6, line 9: delete line 9 in its entirety.

Signed and Sealed this

Eighth Day of May, 2001

*Attest:*

Nicholas P. Godici

NICHOLAS P. GODICI

*Attesting Officer*

*Acting Director of the United States Patent and Trademark Office*